United States Patent [19]

Bouron

[11] Patent Number: 4,539,915

[45] Date of Patent: Sep. 10, 1985

[54] AUTOMATIC FEED DEVICE FOR SOLID FUEL BOILER, SPECIFICALLY FOR LOGS OF WOOD

[76] Inventor: Francis Bouron, 161 Rue de la Valette, 16000 Angouleme, France

[21] Appl. No.: 614,747

[22] Filed: May 29, 1984

[30] Foreign Application Priority Data

Sep. 14, 1983 [FR] France ..... 8314735

[51] Int. Cl.[3] ..... F23N 5/18

[52] U.S. Cl. ..... 110/101 R; 110/101 C; 110/101 CC; 110/289; 110/186; 414/176

[58] Field of Search ..... 110/101 R, 101 C, 101 CF, 110/101 CA, 101 CB, 101 CC, 101 CD, 114, 329, 186, 289; 414/176, 196

[56] References Cited

U.S. PATENT DOCUMENTS

| | | | |
|---|---|---|---|
| 1,335,265 | 3/1920 | Zamernik | 110/101 CC |
| 1,826,106 | 10/1931 | Vodoz | 110/101 R |
| 2,454,400 | 11/1948 | Norman | 110/289 |
| 3,232,254 | 2/1966 | Rivers | 110/101 R |
| 3,298,338 | 1/1967 | Clark, Sr. | 110/101 R |
| 3,903,814 | 9/1975 | Altekruse | 110/101 C |
| 4,339,998 | 7/1982 | Finch | 110/101 CC |
| 4,442,825 | 4/1984 | Waldair | 110/101 CC |
| 4,444,538 | 4/1984 | Manley | 414/176 |

FOREIGN PATENT DOCUMENTS

| | | | |
|---|---|---|---|
| 3132819 | 3/1983 | Fed. Rep. of Germany | 110/101 CA |
| 2484615 | 12/1981 | France | 110/101 C |
| 187524 | 11/1982 | Japan | 110/101 CC |

*Primary Examiner*—Henry C. Yuen

*Attorney, Agent, or Firm*—Rines and Rines Shapiro and Shapiro

[57] ABSTRACT

This invention concerns an automatic feed device for a solid-fuel boiler, specifically for logs of wood. The subject of the invention is an automatic feed device for a solid-fuel boiler, specifically for logs of wood, characterized by the fact that it comprises: a loader (6, 6') having means (19, 66) for receiving a load of fuel (2) to be introduced into the boiler (1) and movable between a loading point for the said load and a point of dumping at the interior of the firebox of the boiler, means (24, 26) for moving the loader, means (29, 30) for controlling the opening of the door (4) of the boiler, means (36, 37) for controlling the dumping of the fuel (2) into the firebox at the end of the course of the loader, and means (44, 58) for detecting the state of combustion at the front of the grate (3) of the boiler, and for controlling the means for moving the loader.

9 Claims, 13 Drawing Figures

AUTOMATIC FEED DEVICE FOR SOLID FUEL BOILER, SPECIFICALLY FOR LOGS OF WOOD

This invention concerns an installation intended to produce the automatic loading of a boiler for domestic use or not, with solid fuel, and in particular, logs of wood.

In France, wood is one of the least costly fuels, especially in the wooded rural zones.

However, the use of wood as a means of heating is rather restraining because of the necessity of regularly loading the boiler with fuel at relatively high frequencies.

The object of this invention is precisely to alleviate these drawbacks while proposing a system for the automatic loading of a boiler with solid fuel, specifically logs of wood, capable of providing continuous maintenance of the combustion in the boiler, and accordingly its continuous operation without any human intervention.

An object of this invention is also to propose such an installation which is capable of the remote lighting of such a boiler, or of relighting it in case of extinction, and also in a totally automatic manner.

In summary, the subject of this invention is an automatic device for feeding solid fuel to a boiler, specifically logs of wood, characterized by the fact that it comprises:

a loader with means for receiving a charge of fuel to be introduced into the boiler, which is movable between a point of loading of the said charge and a point of dumping into the interior of the firebox of the boiler, means for moving the said loader between the two aforesaid extreme points, means for controlling the opening of the entry door to the firebox of the boiler to permit the introduction of the said loader, means for controlling the dumping of the fuel into the firebox at the end of the course of the loader, and means for detecting the state of combustion at the front of the grating of the boiler and for controlling the said means of moving the loader.

Beneficially, the installation also has a device for stocking the charges of fuel capable of delivering the said charges of fuel one at a time through an orifice located directly above the said loader in the loading position.

Figure 1:
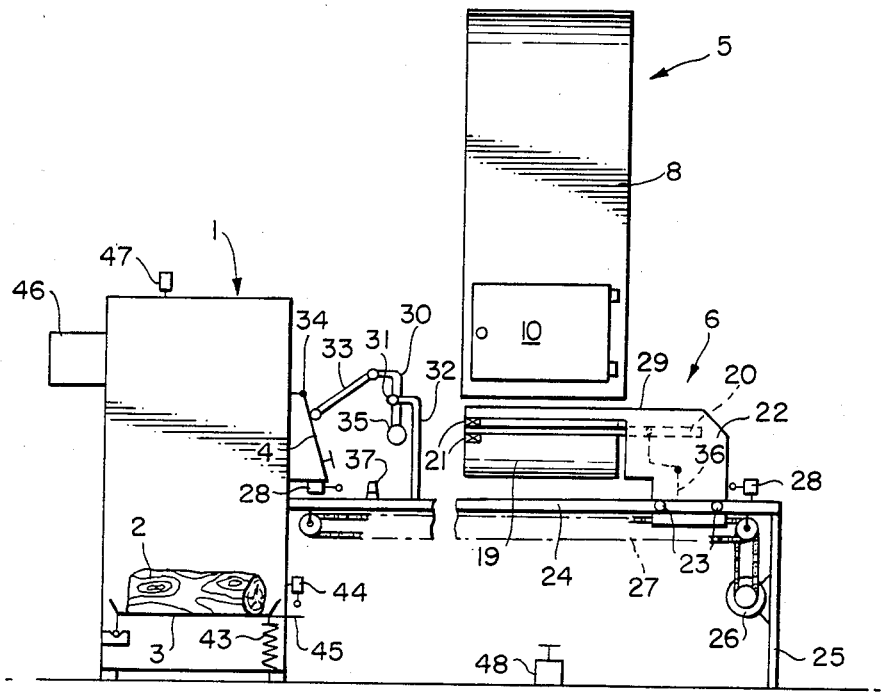
Figure 2:
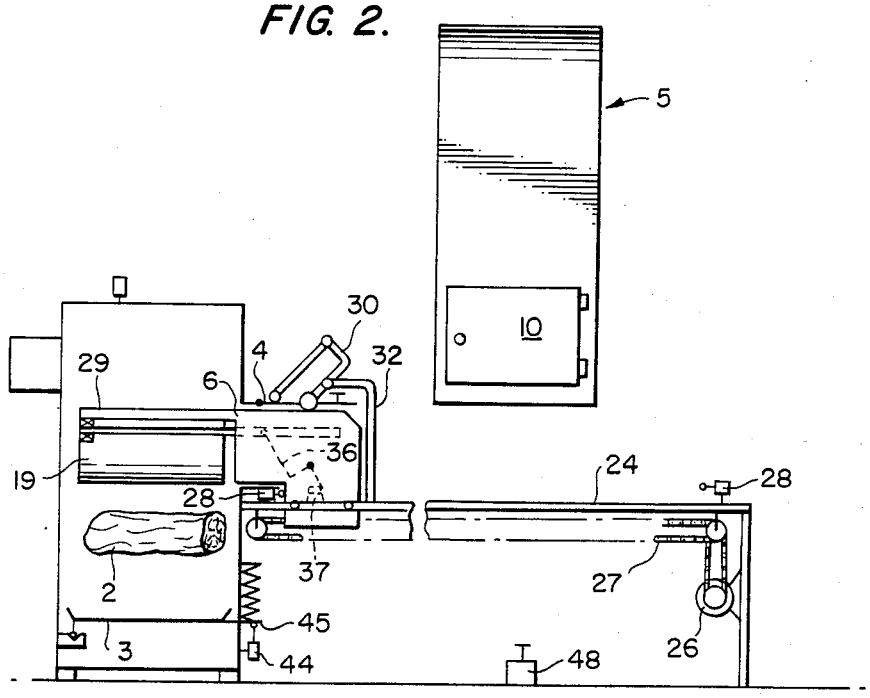
Figure 3:
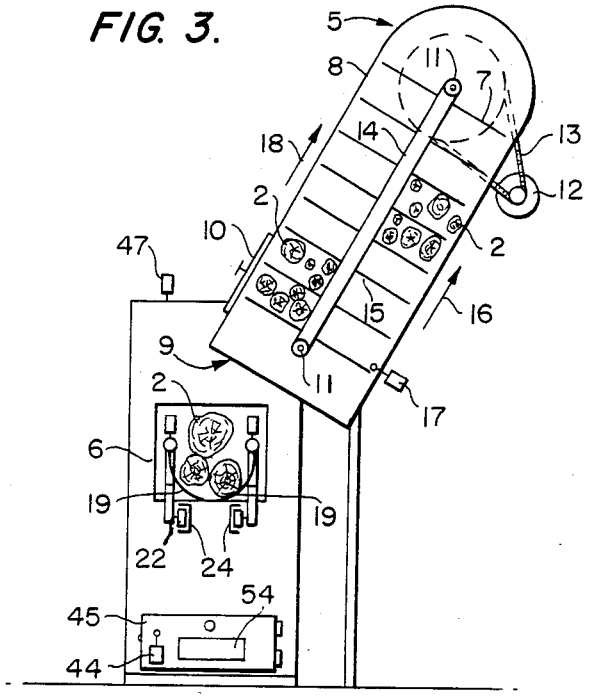
Figure 4:
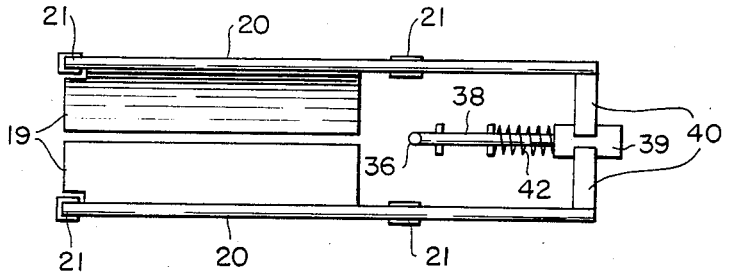
Figure 5:
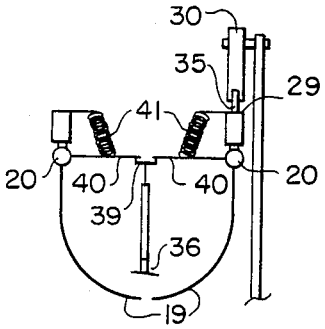
Figure 6:
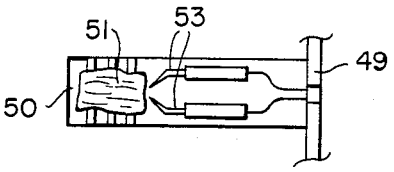
Figure 7:
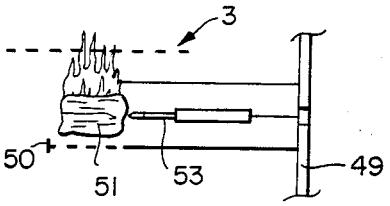
Figure 8:
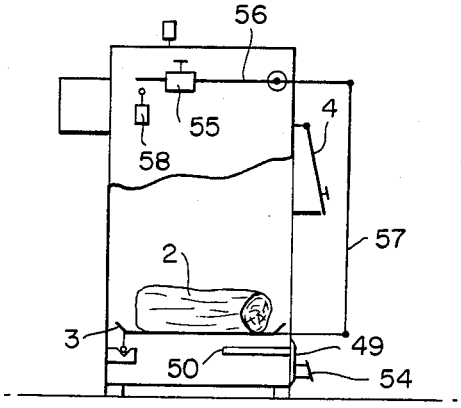
Figure 9:
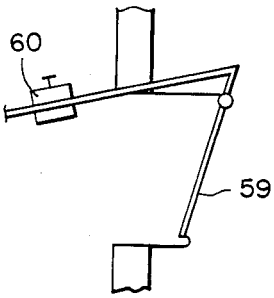
Figure 10:
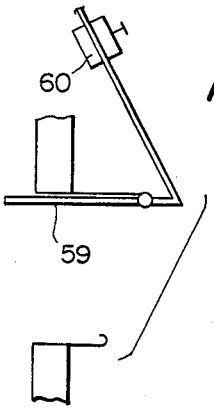
Figure 13:
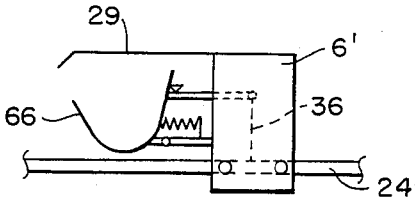
Figure 11:
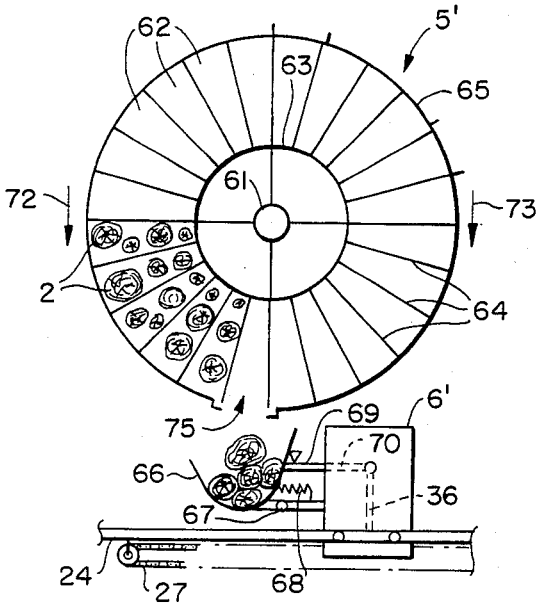
Figure 12:
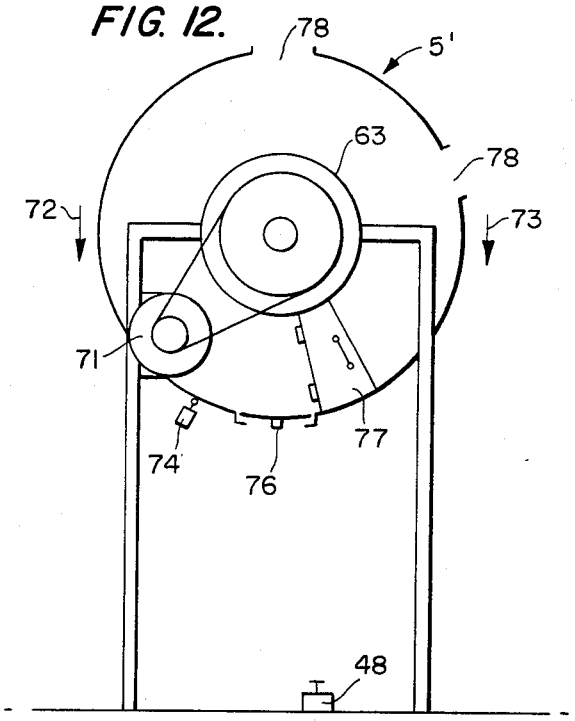

Other characteristics and advantages will be evident from the following description of modes of embodiment of the device pursuant to the invention, with the description being given only by way of example and with reference to the attached drawings, in which:

FIG. 1 represents a schematic view in side elevation of a loading device pursuant to the invention, FIG. 2 represents the device of FIG. 1 with the loading carriage in position for dumping logs into the interior of the boiler, FIG. 3 represents a view from the right of the device of FIG. 1, FIG. 4 represents a top view of the loading carriage, FIG. 5 represents an end view of the loading carriage, FIGS. 6 and 7, respectively, represent a top view and a side view of the lighting device positioned in the interior of the boiler, FIG. 8 illustrates a variation of embodiment of the device for the detection of the lack of fuel in the boiler, FIGS. 9 and 10 illustrate a variation of the method of control of the firebox door of the boiler, in its two extreme closed and opened positions, respectively, FIG. 11 illustrates a variation of embodiment of the means of stocking the logs and of the loading carriage, FIG. 12 illustrates a variation of the device of FIG. 11, and FIG. 13 represents schematically a variation of embodiment of the loading carriage of FIG. 11.

The device shown in FIGS. 1 through 10 comprises a central wood-fired heating boiler 1, domestic or semiindustrial, of conventional design, and capable of burning logs 2 placed on a grate 3 after introduction through a door 4 for entry into the firebox of the boiler.

In accordance with the invention, a storage unit 5 is provided for logs 2, and a system is provided for loading the logs comprising a loading carriage or loader 6 movable back and forth between the opening for dumping from the storage unit 5 and the interior of the boiler 1.

In the mode of embodiment shown, the storage unit 5 (FIG. 3) is composed of an inclined endless conveyor 7 mounted in a casing 8 which has an opening 9 at its bottom end for dumping logs 2 into the loader 6, and a trap door 10 for manual loading of the conveyor 7.

The conveyor 7 passes over two horizontal axles symbolized by 11, and is rotated by a motor 12 and a chain 13.

The conveyor belt 14 of the conveyor is equipped with rigid separating partitions 15 which define compartments receiving the logs 2.

At the bottom end of the storage unit 5 on the return side of the conveyor (in the normal direction 16 for dumping logs), there is a detector 17 for partitions 15. The reverse direction 18 of the conveyor is that for filling the storage unit with logs, as will be seen below.

The loader 6 has two symmetrical trap doors 19 curved inward to form a hopper (FIG. 5) in the position of transport of the logs.

The trap doors 19 are hinged on two parallel axles 20 pivoting in bearings 21 supported by a frame 22 mounted on rollers 23 capable of moving on two parallel horizontal rails 24. These latter are positioned in the axis of the door 4 of the boiler and perpendicular to the opening for discharging the logs from the storage unit 5, and for example, are fastened to the boiler 1 at one end and supported by posts 25 at the other end.

The motion of the loader 6 is accomplished through an electric motor 26 driving an endless chain 27 or the like, which itself drives the frame 22 of the loader.

Limit detectors 28 with microswitches are fastened (adjustably) to each end of the rolling track (24) and define the end positions of the loader 6 by stopping the motor 26. These detectors 28 interact with the frame 22 of the loader.

The loader 6 is equipped with a horizontal arm 29 to control the opening of the door 4 of the boiler. Like the trap doors 19, this arm is positioned to overhang on the frame 22 in the direction of the boiler.

The arm 29 is capable of acting on a lever arm 30 hinged on a horizontal axle 31 kept immovable at the upper end of a post 32 fastened to the rails 24. The lever 30 acts through a connecting rod 33 on the door 4 hinged at 34.

The end of the lever 30 is equipped with a roller 35 capable of rolling on the upper face of the arm 29 (FIG. 2).

The opening of the hopper or basket formed by the trap doors 19 for the purpose of dumping their load is accomplished by the use of a lever 36 hinged on the frame of the loader 6 and capable of interacting with a fixed bumper 37 supported by the rails 24.

The lever 36 is integral with a rod 38 equipped at its end with a paddle 39 serving as a lock with two arms 40 for blocking the axles 20 of the trap doors 19.

The arms 40 are brought back into their normal horizontal position (FIG. 5) by springs 41.

The arm 36 and the locking paddle 39 are brought back into their normal position (FIG. 4) by a spring 42.

The boiler 1 is equipped pursuant to the invention with a system for the detection of the end of the fuel composed of an assembly movable vertically from the grate 3, which has a spring system 43 acting in opposition to the weight of the logs 2 on the grate, so that the weight exerted on the grate 3 is reduced in accordance with the consumption of the logs, and the grate rises under the action of the springs 43 until it triggers a detector 44. This detector is located outside of the boiler and is acted on by a lever 45 integral with the grate 3.

Finally, in FIG. 1, the smoke duct is shown at 46, the boiler temperature thermostat at 47, and at 48, an operating control foot switch behind the storage unit 5.

FIGS. 6 and 7 show a mode of embodiment of an automatic lighting system for the boiler which can be added as an accessory to the installation of FIG. 1. In these figures, the access door for removing ashes from the boiler has been shown at 49. At right angles to this door inside the boiler is located a horizontal cup 50 perforated at the end and holding a combustible block 51 (for example, a barbecue lighter). Inside the tubular part of the cup are placed ignition electrodes 53 connected to a suitable power and control device (not shown).

In FIG. 8, the placement of the cup 50 in the boiler beneath the grate 3 and above the air damper 54 of the ash-removal door has been drawn schematically.

This same FIG. 8 shows a variation of embodiment of the means of detection of the lack of fuel in the boiler. In accordance with this variation, the grate 3 is always mounted to move vertically, or rather pivoting toward the front, but it carries along here a system of counterweights 55 attached (outside of the boiler) to the end of a lever 56 hinged on a fixed axle. The connection between the lever 56 and the grate 3 is made by a connecting rod 57.

A microswitch detector 58 is intended to detect the position of maximum lifting of the grate 3 resulting from lack of fuel.

This detector 58, like the detector 44 of FIG. 1, is connected to the motor 12 of the storage unit 5, but the detector 17 of the storage unit is connected to the motor 26 of the loader 6.

The installation described above operates as follows.

When the boiler is in operation the storage unit 5 is in the position of FIG. 3 and the loader 6 is in the position of FIG. 1.

When the lack of fuel is detected, by the lifting of the grate 3 under the action either of the springs 43 or of the counterweights 55, the detector 44 (or 58) commands the startup of the motor 12 of the storage unit 5. The conveyor 14 moves in the direction 16 and dumps the logs contained in the first compartment which appears into the loader 6.

The conveyor stops when the head partition 15 of this compartment reaches the detector 17, so that a single compartment is emptied.

The detector 17 commands the startup of the motor 26. The full loader 6 travels toward the door 4 which it opens by means of the system of arms and levers 29–30–33. The door 4 is lifted and permits the entry of the loader to its extreme position of introduction (FIG. 2) into the boiler.

The loader is commanded to stop by the detector 28 on the boiler.

Just before reaching this detector 28, the bumper 37 has caused the lever 36 to pivot. This latter disengages the blade 39, releases the blocking arms 40, and permits the tipping of the flaps 19 under the weight of the logs 2, and accordingly permits them to slide onto the grate 3 which is located below.

The flaps 19 return immediately into the folded position (FIG. 5) and the motor 26 is automatically restarted, but in backward operation after a certain delay after it is stopped by the detector.

At the end of the return course of the loader 6, the detector 28 stops the motor 26.

Such a reloading cycle will be repeated automatically each time the detector 44 or 58 detects a lack of fuel.

The storage unit 5 is loaded manually by opening the trap door 10 and operating the motor 12 by the foot switch 48 in the direction 18 to bring the empty compartments successively in front of the loading opening.

FIGS. 9 and 10 show a firebox door construction 59 of the swinging type with exterior counterweights 60. This type of door can be substituted for the type shown in FIG. 1. The door 59 is then simply pushed by the arms 29 of the loader 6 when it penetrates into the boiler.

In the variation of FIGS. 11 and 12, the storage unit 5' is of the revolving type, i.e., it is composed of a circular magazine with horizontal axle 61. The various compartments 62 for logs 2 are confined between a rotary drum 63, radial partitions 64 integral with the drum, and a fixed enveloping cylindrical casing 65.

The axle 61 is arranged perpendicular to the line of motion of the loader 6' toward the firebox of the boiler. The structure of the loader is accordingly modified. The logs 2 are received on the loader in a receiver 66 in the form of a trough with its axis parallel to the axle 61 and mounted to pivot on the frame of the loader 6' around an axle 67, with a return spring 68 restoring the trough 66 into the normal position (FIG. 11). The trough 66 is locked in this last position by a system of latches 69 unlocked by a lever 70 integral with the aforesaid hinged lever 36.

The drum 63 is driven by a motor 71 in one direction 72 to feed the loader 6' and in the other direction 73 for its own refilling with logs.

The motor 71 is controlled in the direction of refilling by the foot switch 48 and in the other direction 72 by the detector 44 or 58 of the installation.

A detector 74 for the position of the compartments 62 is provided on the casing 65 just above the opening 75 for dumping into the loader 6' (FIG. 12) during the manual loading of the storage unit 5'. This latter unit can be filled either from the side through a side trap 77 in the casing 65 (front loading) or radially through one or more systems of openings and movable traps 78.

The loader 6' is also equipped (FIG. 13) with arms to command the opening of the firebox door of the boiler.

The installation pursuant to the invention completely automates the control of the boiler, which itself requests the necessary fuel at the desired moment. It should be noted that the provision of the lighting device (FIGS. 6–7) permits starting the boiler without human intervention, by programming or by telephone, for example.

The motion of the grate 3, of course, can be regulated to adapt the heating rate of the boiler according to the seasons or the needs. In regulating this motion, it will be possible to act on the detector 44 (or 58) according to different weights of the grate, i.e., different stages of completion of combustion, more or less advanced.

The loader 6 permits maintaining a high rate of combustion in cold seasons (winter) or maintaining a low combustion in mild seasons (autumn and spring) just to avoid extinction.

The adjustment of the loading command in cold weather is less delicate, i.e., reloading is done at the end of the first phase of combustion, before the ember state.

After this phase, the strong demand of the installation tends to be no longer satisfied, the air damper 54 opens when much less oxygen is needed to complete ember combustion (second phase of combustion). The phenomenon of air flushing begins.

On the other hand, in mild weather, since the demand of the installation is low, the damper 54 having a tendency to be closed constantly, the command for loading waits for the end of the second phase of combustion (light bed of embers).

Since a rather long time has been necessary to arrive at this state, with the damper closed the installation makes a gentle demand, the damper tends to open and coincides with a small load (one log for example), which permits the production of a good first phase of combustion with normal oxygenation.

From a general point of view, the boiler never operates as a gas generator; the oxygenation damper for the combustion is always more or less open at the desired moment. The wood can burn under the best conditions; there is no unburned gas.

The combustion temperature is higher, which permits burning the tars contained in the combustion gases.

The automatic loader 6 avoids the escape of smoke through the loading door 4 since the filling of the firebox is always done at the end of the first phase of combustion. The release of smoke is slight, and the draft is at its strong point.

The automatic loading avoids manual ash removal. The logs fall in a block on the grate in suspension, spring or counterweight. The grate, being at its high position to command the loading, strikes the lower bumper several times by the effect of rebound.

The capacity of the storage unit 5, 5' is calculated for several days of automatic operation.

The loader 6 can use logs of any shape 0.50 m in length for small and moderate installations, and 1 m for a large installation.

The loader-storage unit assembly takes up relatively little floor space and can be adapted to existing boilers, in which it is necessary only to change the access door to the firebox and to adapt the combustion grate.

Pursuant to another advantage of the device of the invention, there is no risk of fire in case of electrical or mechanical failure; since the boiler is not integral with the loader and the fuel storage unit, the propagation of the fire is zero.

Pursuant to another benefit, the boiler of the installation pursuant to the invention cannot get out of control, since it is supplied with fuel only load by load, with each load being limited and replaced by the following one only at the end of its combustion, and if the fire should get out of hand in spite of everything, it would be very short and would be fed only by the following charge of fuel, since the installation is beneficially equipped with a thermostat which temporarily stops the reloading of the boiler in case the temperature of the boiler water exceeds a limited threshold, for example 80° C.

Of course, the invention is not limited to the modes of embodiment shown and described above, but on the contrary, it covers all of the variations of them, specifically relative to the structure and arrangement of the loader 6 and of its means of command, guidance, and control, of the storage unit 5 and of the means of triggering the device by detection of the state of combustion on the grate, with these various devices or subassemblies possibly being embodied by other means, provided they accomplish the same functions.

Finally, the invention can be applied to the loading of solid fuels other than wood, such as coal, or to the loading of powdered fuels (coal, wood chips, sawdust, etc.).

What is claimed is:

1. An automatic feed device for feeding logs and the like to a solid-fuel combustion chamber having a grate therein on which the fuel is burned and having a door through which fuel enters said combustion chamber to be dropped onto said grate, said device comprising storage means remote from said combustion chamber for storing fuel to be burned, carriage means for receiving successive charges of fuel from said storage means, conveyor means for moving said carriage means from said storage means to said combustion chamber, said carriage means having a cantilevered portion that carries a charge of fuel into said combustion chamber through said door to a limit position over said grate and that has means for thereafter discharging said charge of fuel therefrom to drop onto said grate, and automatic control means for detecting the state of combustion at said grate, for causing a charge of fuel in said storage means to be supplied to said carriage means, for causing said conveyor means to move said carriage means to said combustion chamber until said cantilevered portion is in said limit position, for then causing said discharging means to drop said charge of fuel from said carriage means to said grate, and for thereafter causing said conveyor means to return said carriage means to said storage means, said storage means including motor driven means for delivering successive charges of fuel to said carriage means step-by-step, said automatic control means including means for controlling the energization of said motor driven means, said conveyor means comprising a motor and said automatic control means including limit sensing means for controlling the motor of said conveyor means in response to said carriage means reaching limits of travel toward and away from said combustion chamber, respectively.

2. A device in accordance with claim 1, wherein said discharging means comprises trap door means opened to drop a charge of fuel onto said grate.

3. A device in accordance with claim 1, wherein said discharging means comprises a trough that is tipped to drop a charge of fuel onto said grate.

4. A device in accordance with claim 1, wherein said discharging means has means for actuating the same automatically when said cantilevered portion is over said grate.

5. A device in accordance with claim 1, wherein said detecting is responsive to the weight of fuel on said grate.

6. A device in accordance with claim 1, wherein said carriage means has means for opening said door automatically as said carriage means approaches said combustion chamber.

7. A device in accordance with claim 1, wherein said motor driven means comprises an endless conveyor with compartments holding said successive charges of fuel and driven by motor means energized by said detecting and deenergized by means that senses step by step movement of said endless conveyor to deliver successive charges of fuel to said carriage means.

8. A device in accordance with claim 1, wherein said motor driven means comprises a rotary drum having radial partitions defining compartments for said successive charges of fuel inside a fixed cylindrical casing.

9. A device in accordance with claim 1, wherein said combustion chamber has automatic remote-control lighter means including a receptacle for a block of kindling fuel and ignition electrodes.

* * * * *